United States Patent [19]

Hansen et al.

[11] 4,271,231

[45] Jun. 2, 1981

[54] PROCESS FOR SECURING BULK LOADS IN MOTOR COASTERS AND OCEAN-GOING VESSELS AGAINST SHIFTING

[75] Inventors: Guenter Hansen, Frankenthal; Hermann Pottgiesser; Walter Schlindwein, both of Ludwigshafen, all of Fed. Rep. of Germany

[73] Assignee: BASF Aktiengesellschaft, Fed. Rep. of Germany

[21] Appl. No.: 80,217

[22] Filed: Oct. 1, 1979

[30] Foreign Application Priority Data

Sep. 30, 1978 [DE] Fed. Rep. of Germany ..... 2842714

[51] Int. Cl.[3] ..... B32B 5/16; C09J 5/00

[52] U.S. Cl. ..... 428/323; 114/75; 156/62.2; 156/305; 427/212; 427/221; 428/407

[58] Field of Search ..... 156/62.2, 305, 333, 156/334; 264/128; 427/212–221; 428/409, 407, 403, 323, 327; 114/73–75

[56] References Cited

U.S. PATENT DOCUMENTS 2,994,632 8/1961 Brown et al. ..... 428/463

FOREIGN PATENT DOCUMENTS 854377 11/1960 United Kingdom ..... 114/75
882139 11/1961 United Kingdom ..... 427/221
624817 8/1978 U.S.S.R. ..... 114/73

*Primary Examiner*—John J. Gallagher
*Attorney, Agent, or Firm*—Oblon, Fisher, Spivak, McClelland & Maier

[57] ABSTRACT

Bulk loads in motor coasters and ocean-going vessels can be secured against shifting as a result of listing or pitching, by consolidating the surface layer of the trimmed bulk material by bonding the individual particles with a binder.

17 Claims, No Drawings

PROCESS FOR SECURING BULK LOADS IN MOTOR COASTERS AND OCEAN-GOING VESSELS AGAINST SHIFTING

BACKGROUND OF THE INVENTION

1. Field of the Invention

The present invention relates to a process for securing particulate bulk loads in motor coasters and ocean-going vessels.

2. Description of the Prior Art

Raw materials and finished products are increasingly being transported as bulk loads. This is true of both river and seaborne transport. In the days of the sailing ship, it was in particular grain which was shipped in bulk. Nowadays, about 25% of the world's merchant tonnage is available as bulk carriers for transporting coal, ores, grain, minerals, salts, fertilizers and other materials in bulk form.

A precondition for this very economical type of transportation is that the products should be reasonably insensitive to weather factors, so that it is possible to dispense with packaging, for example in sacks, which in particular provides protection against moisture. Whilst this property is a precondition for preserving the quality of the goods, there are other properties which are of considerable importance for the safety of the ship and its crew.

These properties concern the resistance which granular bulk material offers to the relative shift of its particles, that is to say concern the problem that bulk loads can, during sea transportation, start to slip as a result of vibration and above all as a result of the list of the vessel about its longitudinal axis. The sliding resulting from the list leads to a shift in the load and hence to a shift in the center of gravity of both the load and the vessel, with all that this implies regarding the stability of the vessel.

In the past, many grain clippers were lost due to their loads shifting. Even at the present time, motor vessels still capsize for this reason in heavy seas, and fast ships are endangered by hard corrections of their course, even in calm seas.

In order to counter these hazards which arise when shipping bulk loads, the loose cones of the load are trimmed more or less flat before leaving port. As a result, the danger of a transverse shift in the load is, ideally, avoided up to an angle of list of the ship which approximately corresponds to the natural angle of repose of the particular bulk material. If the ship is piloted expertly, angles of list above a maximum value of about 35° will not occur, and bulk materials having a natural angle of repose above this maximum value can be transported safely.

Bulk goods having a low natural angle of repose require additional measures. The relevant guidelines recommend plane trimming and, where necessary, fitting of longitudinal bulkheads into the holds. Certain products, such as grain, exhibit special flow of the moving material. With such goods, a shift in the load is also hindered by loading the trimmed surface by means of stacks of bagged material several meters high. These steps—especially the longitudinal bulkheads which may have to be fitted—adversely affect the economics, and hence the benefits, of bulk loading. An additional fact is that only a few goods, such as grain, can be unloaded pneumatically; if, on the other hand, unloading is to be by means of grabs, the temporary auxiliary bulkheads in general greatly hamper unloading.

In addition to taking the measures described, shifts in loads can also be reduced by suitable construction of the ships. Thus, at the present time, bulk freighters can be built to be, in a sense, self-trimming, by matching the shape of the holds to the angle of repose of the load. This construction proves of value in special ships for bulk loads having a particular bulk density which always remains the same. However, the construction is ineffective if, for example, the hold is only half-filled or if bulk loads of different bulk density, in particular of higher bulk density, are involved.

SUMMARY OF THE INVENTION

It is an object of the present invention to make the transport of bulk loads on motor coasters and ocean-going vessels safe by simple means while avoiding the shortcomings of the previously used means.

We have found that this object is achieved and that bulk loads in motor coasters and ocean-going vessels can advantageously be secured against shifting as a result of listing or pitching, by consolidating the surface layer of the trimmed bulk material by bonding the individual particles with a binder.

DESCRIPTION OF THE PREFERRED EMBODIMENTS

Bulk loads for the purposes of the invention mean the conventional, mostly granular, materials, for example grain, mineral fertilizers, plastics, ores and coal. The novel process is of particular interest for grain and mineral fertilizers as well as for crystalline ammonium sulfate, potassium chloride and crude phosphate.

In general, the binders can be used for the process in the form of their aqueous solutions or in the form of aqueous dispersions, even if the bulk materials are water-soluble. Binders of particular interest are aqueous dispersions of copolymers of vinyl compounds, especially dispersions which have a film-forming temperature above 0° C., and contain copolymers having a glass transition temperature of below 30° C. and a film strength greater than 0.7 $N/mm^2$. Particularly advantageous binders are vinyl copolymers which give films having a film strength greater than 1 $N/mm^2$ and which, at an elongation of half the elongation at break exhibit permanent elongation of less than 5%. Examples of suitable vinyl copolymers are conventional emulsion copolymers based on butadiene and styrene, emulsion copolymers based on vinylidene chloride, acrylonitrile and $\alpha,\beta$-olefinically unsaturated monocarboxylic and dicarboxylic acids, eg. acrylic acid and itaconic acid, and emulsion copolymers of monoolefinically unsaturated carboxylic acid esters, in particular vinyl esters and acrylates.

Aqueous solutions of urea-formaldehyde precondensates may also be used. Binders of particular interest are conventional aqueous dispersions, mostly of from 40 to 60% strength, of polymers containing from 30 to 60% by weight of butadiene, from 30 to 60% by weight of styrene and from 0 to 8% by weight of acrylic acid, methacrylic acid, itaconic acid, acrylamide, methacrylamide and/or N-methylolmethacrylamide as copolymerized units.

In the process, the binders can be sprayed onto the upper layer of the trimmed bulk loads, for example from one-material nozzles. In general, the binder is employed in amounts of from 200 to 2,000 grams per $m^2$ of surface of the bulk load. After drying, which takes place rapidly, this treatment results in a mat-like consolidation of the bulk load particles present in the surface region. This consolidated region should preferably have a depth equal to several times the particle diameter; in most cases, a layer from 1 to 5 cm thick suffices. Before unloading, the consolidated upper layer of the bulk load can, if desired, easily be lifted off and, where necessary, be discarded. However, the layer also offers virtually no resistance to unloading by conventional grabs, so that frequently it is not necessary to remove the surface layer when unloading.

Since the novel process produces rapid consolidation of the surface layer of the trimmed bulk load, there is no increase in the number of lay days. The surface consolidation substantially ensures that the load is safe against shifting at the list angles encountered at sea. In view of the large total weights of materials loaded as bulk loads, and the extremely small amount of binder required in relation thereto, it is surprising that shifting of the load can be reliably prevented even in heavy seas.

Having now generally described this invention, the same will be further illustrated by the following examples which are provided herein for the purposes of illustration only and are not intended to be limiting thereof.

For the purpose of the Examples which follow, the hold of a ship is represented by a simulator of 1 meter length, 1 meter width and 0.6 meter depth. Defined tilting motions can be applied about an axis running through its center of gravity. The load is subjected to 10 lists in both directions per minute. The angle of list is increased from ±35° to ±45° during the simulated test. The parts and percentages in the Examples which follow are by weight.

EXAMPLE 1

The simulator is filled with a granular fertilizer (particle size 2 to 6 mm) of 30° angle of repose, and is trimmed flat. The trimmed surface of the load is sprayed uniformly using a one-material nozzle, with a 33% strength aqueous dispersion of a copolymer of 40 parts of butadiene and 60 parts of styrene, the dispersion having a film-forming temperature above 0° C., and the copolymer having a glass transition range of from 10° to 20° C., a film strength of 9 N/mm$^2$ and a permanent elongation of 0%.

The dispersion penetrates about 1 cm into the surface of the fertilizer granules and consolidates this layer. After about 1 hour, lists of ±35° were applied to the simulator. After a further 2 hours, the lists were increased to ±45° and maintained for a total of 90 hours (108,000 lists). The surface of the load remains unchanged after this test.

If, by contrast, the simulator filled with granular fertilizer is subjected to the lists without the surface layer having been consolidated in accordance with the invention, even the first list of ±35° results in a transverse shift of the load, and the simulator becomes lopsided and no longer straightens itself from this position.

EXAMPLE 2

The simulator is filled with hard wheat having an angle of repose of 27° and the trimmed surface is consolidated with an 8 mm thick layer of a 50% strength aqueous dispersion of a copolymer of 90 parts of vinylidene chloride, 8 parts of acrylonitrile and 2 parts of acrylic acid. The dispersion has a film-forming temperature above 20° C. and the copolymer has a glass transition temperature of 15°-25° C., a film strength of 12 N/mm$^2$ and a residual tensile deformation of 0%. After 2 hours, the load is subjected to lists of ±35°. After 90 hours, the surface still shows no change. It also withstands subsequent lists of ±40° until it tears after a total of 138 hours (165,000 lists), so that the experiment is discontinued.

EXAMPLES 3 to 5

The simulator is filled with crystalline ammonium sulfate (particle size 0.4–2 mm, mean diameter 1.25 mm), having an angle of repose of 35° [Example 3], or potassium chloride (particle size 0.3–1.5 mm, mean diameter 0.75 mm), having an angle of repose of 31° [Example 4], or crude phosphate (pebbles, particle size 0.1–2.8 mm, mean diameter 0.7 mm), having an angle of repose of 32° [Example 5], and the trimmed surfaces are consolidated with (a) a commercial 40% strength aqueous dispersion of a copolymer of 60% by weight of n-butyl acrylate and 40% by weight of styrene, or (b) a commercial 50% strength aqueous dispersion of a copolymer of 52% by weight of styrene, 45% by weight of butadiene, 2% by weight of acrylic acid and 1% by weight of acrylamide, or (c) a commercial 50% strength aqueous dispersion of a copolymer of vinyl propionate with 2% by weight of vinylpyrrolidone and 2% by weight of methacrylamide, the amount of polymer in each case being 1 kg/m$^2$ of bulk load surface.

The glass transition temperatures of the copolymers are below 30° C. and their film strength above 1 N/mm$^2$.

Loads 3*a*—3*c* and 4*a*—4*c* are subjected to lists of ±42° after 2 hours, and loads 5*a*—5*c* only after 10 hours. After 90 hours, the surfaces of the loads still show no changes.

What is claimed as new and intended to be covered by Letters Patent of the United States is:

1. A process for securing particulate bulk loads in motor coasters and ocean-going vessels against shifting as a result of list or pitching, which comprises:

bonding the surface layer of particles of the trimmed bulk load by uniformly applying thereto an aqueous solution or dispersion of a polymeric binder and drying to form a consolidated surface layer.

2. The process of claim 1 wherein said binder is used in the form of an aqueous dispersion.

3. The process of claim 2 wherein said dispersion of binder is an aqueous dispersion of a copolymer.

4. The process of claim 3 wherein said copolymer is a dispersion of a copolymer of a vinyl compound, having a film forming temperature above 0° C., wherein the copolymer has a glass transition temperature below 30° C. and a film-strength above 0.7 N/mm$^2$.

5. The process of any of claims 3 or 4 wherein said copolymer is selected from the group consisting of an emulsion copolymer of butadiene and styrene, an emulsion copolymer of vinylidene chloride, acrylonitrile and $\alpha,\beta$-olefinically unsaturated mono- and di-carboxylic acids, and an emulsion copolymer of a mono-olefinically unsaturated carboxylic ester.

6. The process of claim 2 wherein said polymeric binder is an aqueous solution of a urea-formaldehyde precondensate.

7. The process of claim 3 wherein said copolymeric aqueous dispersion has a concentration of 40–60% by weight.

8. The process of claim 1 wherein said binder is employed in amounts of 200–2000 g per $m^2$ of surface of said particulate bulk load.

9. The process of claim 1 wherein the surface of the particulate bulk load is consolidated in a layer having a thickness equal to several times the particulate diameter.

10. The process of claim 9 wherein the consolidated layer has a thickness of 1–5 cm.

11. The process of claim 1 wherein said particulate bulk load is selected from the group consisting of grain, mineral fertilizers, plastics, or coal.

12. The process of claim 11 wherein said particulate bulk load is selected from the group consisting of crystalline ammonium sulfate, potassium chloride and crude phosphate.

13. The secured consolidated particulate bulk load of claim 1.

14. The process in accordance with claim 1 wherein said copolymer is a copolymer of from 30% by weight to about 60% by weight butadiene, from about 30% by weight to about 60% by weight styrene, and from 0% by weight to about 8% by weight of one or more members of the group consisting of acrylic acid, methacrylic acid, itaconic acid, acrylamide, methacrylamide and N-methylolmethacrylamide.

15. The process in accordance with claim 14 wherein said copolymer is a copolymer of 40% by weight butadiene and 60% by weight styrene.

16. The process in accordance with claim 14 wherein said copolymer is a copolymer of 45% by weight butadiene, 52% by weight styrene, 2% by weight acrylic acid and 1% by weight acrylamide.

17. The process in accordance with claim 5 wherein said copolymer is a copolymer of 90% by weight vinylidene chloride, 8% by weight acrylonitrile and 2% by weight acrylic acid.

* * * * *